United States Patent [19]

Schuegraf

[11] 4,293,829

[45] Oct. 6, 1981

[54] POLARIZATION SEPARATOR

[75] Inventor: Eberhard Schuegraf, Munich, Fed. Rep. of Germany

[73] Assignee: Siemens Aktiengesellschaft, Berlin & Munich, Fed. Rep. of Germany

[21] Appl. No.: 77,190

[22] Filed: Sep. 20, 1979

[30] Foreign Application Priority Data

Sep. 29, 1978 [DE] Fed. Rep. of Germany ..... 2842576

[51] Int. Cl.[3] ..... H01P 1/16; H01P 5/08

[52] U.S. Cl. ..... 333/125; 333/137; 333/21 A; 333/33; 333/251

[58] Field of Search ..... 333/117, 125–127, 333/135, 137, 21 A, 21 R

[56] References Cited

U.S. PATENT DOCUMENTS 3,978,434 8/1976 Morz et al. ..... 333/135

4,176,330 11/1979 Di Tullio et al. ..... 333/135 X

FOREIGN PATENT DOCUMENTS 2521956 11/1976 Fed. Rep. of Germany .

2708271 8/1978 Fed. Rep. of Germany .

*Primary Examiner*—Paul L. Gensler

*Attorney, Agent, or Firm*—Hill, Van Santen, Steadman, Chiara & Simpson

[57] ABSTRACT

A polarization separator or diplexer for ultra-high frequencies utilizing waveguide sections of rectangular and/or round cross-section in which the signals passing through are phase synchronized over a particular frequency range and which can be manufactured very inexpensively and is operable over a broad frequency band and wherein the arms of the series branching waveguides and the E and H offset portions have a ratio of the narrow to wide sides of at least 1:4 and the first portion of the double branching for providing a connection and transition to the coaxial waveguide comprises an impedance level transformer which has variations in the cross-section of the inner conductor and the outer conductor.

12 Claims, 4 Drawing Figures

POLARIZATION SEPARATOR

BACKGROUND OF THE INVENTION

1. Field of the Invention

This invention relates in general to polarization separators or diplexers for ultra-high frequency waveguides of rectangular and/or round cross-section which are symmetrically constructed with five arms which contain a first arm lying in the longitudinal axis of the arrangement and is adapted to connect the device to continuing waveguides of round or four sided cross-section and wherein four waveguides of rectangular sections designed similarly which are arranged and respectively rotated by 90° with respect to one another and where the four waveguides of rectangular cross-section extend in the direction opposite to that of the first connecting waveguide portion and wherein the two pairs of waveguides opposite each other are connected with separator waveguide arms sections which are identical to each other by two identical series branch waveguide structures. Two of the respective separator waveguide sections which lie between the partial arms of the double branching waveguides which are opposite each other and the partial arms of the series branching waveguides are formed as E-offset members and as H-offset members. The E-offset members are respectively designed as rectangular waveguide members which are provided with waveguide bends on both sides and are respectively bent across the broadside of the waveguide in opposite directions. Both E-offset members are aligned with respect to their narrow sides obliquely to the longitudinal axis of the structure and extend parallel to each other. The H-offset members are designed as rectangular waveguide portions which have waveguide bends on both sides and are bent across the narrow side of the waveguide in opposite directions and one of the E-offset members is mounted between the two H-offset members such that the series branching connected to the E-offset members and the H-offset members do not penetrate each other.

2. Description of the Prior Art

German Patent Application P 27 08 271.9 which was published Aug. 31, 1978 discloses a polarization separator and diplexer upon both of the waveguide paths provide almost complete phase synchronization and the rectangular waveguide openings are arranged parallel relative to the longitudinal axis so that the flange connections of the rectangular waveguide can be mounted in a single plane.

SUMMARY OF THE INVENTION

A polarization separator diplexer provides connection between one of two mutually independent polarizations of a wave mode in one and the same line, for example, the connection between a respective $H_{11}$-wave in the round waveguide or a $H_{10}$- or, respectively, $H_{01}$-wave of a quadratic waveguide and a respective, separate terminal assigned to only one specific polarization direction in the common line. As a rule, the common line for the two polarizations is designed as a waveguide with a round or quadratic cross-section in which the two polarization forms of the same wave mode respectively exist next to each other and are balanced and completely de-coupled from each other and the connection cross-section of the respective individual polarization means is standard, with respect to polarization and wave mode, as a standard rectangular waveguide with a side ratio of a:b=2:1. Between the rectangular waveguide connections and the round or quadratic waveguide wherein the quadratic guide has a side ratio of a:b=1:1 which determines the line impedance level, there is a line impedance jump of 1:2 in the conducting path for each of the two polarizations, and a reflection factor having a magnitude of 1/3 results. In a polarization separator or diplexer according to German patent application P 27 08 271.9 in which each of the two polarization portions is symmetrically over-coupled for the suppression of disruptive, higher wave modes, such impedance level jump must be bridged with four special multi-stage waveguide transformers with a rectangular cross-section in order to achieve a sufficiently low reflection factor. Such transformers are very low in reflection in frequency bands approximately up to widths of $f_o/f_u=1.35$. If, however, the frequency range is expanded to a full waveguide band of approximately $1.1f_{KH10}<f<1.97f_{KH10}$, as is generally the case in 4/6GHz satellite communications, then the number of stages of transformers required for this purpose would increase significantly and the manufacturing cost outlay of the four stage transmitters required in such a polarization separator or diplexer which must be constructed to be mechanically exactly identical to each other in order to retain phase symmetry and purity of the wave modes becomes substantial.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
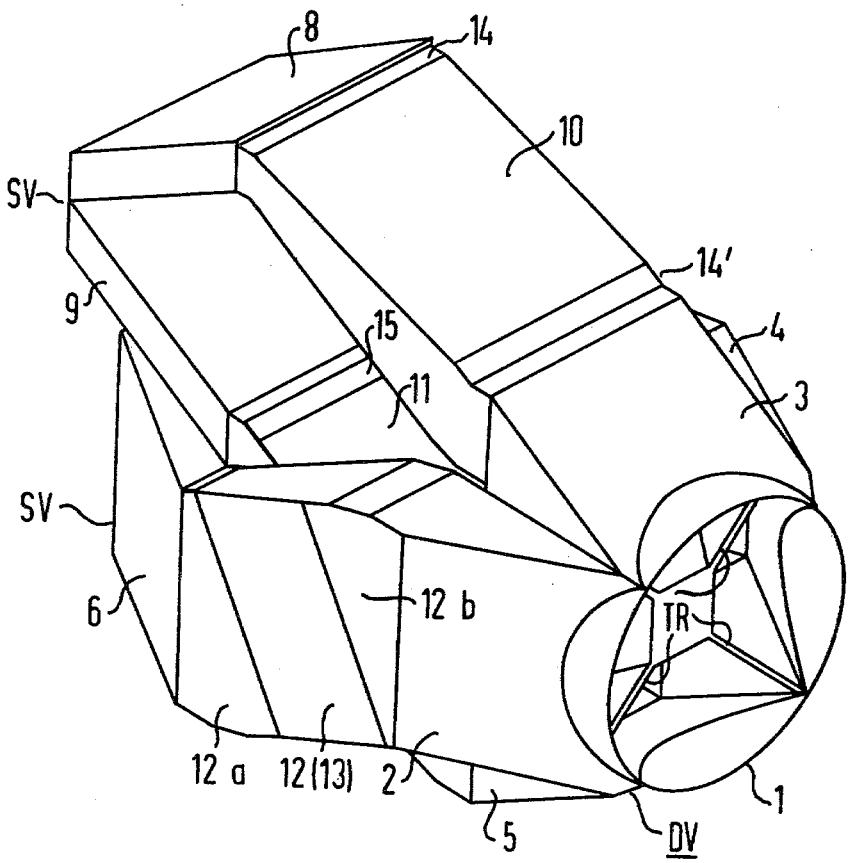
FIG. 1 illustrates a polarization separator or diplexer arrangement proceeding from the parent patent.

Five-armed branching, referred to subsequently as double branching DV is illustrated in the right-hand portion of FIG. 1. Such a double branching structure is known as a component part of a polarization separator or diplexer as shown in German OS 2,521,956 which consists of a first waveguide arm 1 lying in the longitudinal axis of the arrangement and formed as a cylinder and provides for connecting with a continuing waveguide having round or quadratic cross-section. Four identically designed partial waveguide arms 2 through 5 which are respectively arranged to be turned by 90° with respect to each other extend in the direction opposite to the first waveguide arm 1 and have the same angle with respect to the longitudinal axis of the arrangement. The partial waveguide arms of the double branching have rectangular cross-sections and the rectangular waveguide pairs 2 and 4 and 3 and 5, respectively, which lie opposite each other are constructed so as to be completely symmetrical. In FIG. 1, the partial arms 4 and 5 are partially covered by the partial arms 2 and 3 and are therefore not specifically illustrated for reasons of clarity. The double branching DV can be represented as four identical rectangular passages which are introduced into a right parallelepiped with a uniform angle with respect to its center line, and the passages being respectively turned by 90° with respect to each other relative to the axis of symmetry of the arrangement which is identical to the axis of the output waveguide.

The two partial arms 2 and 4 or, respectively, 3 and 5 of the double branching respectively opposite one another are connected in pairs with the separator waveguide arm sections.

The separator or diplexer waveguide arm sections which will be explained in greater detail comprise the partial waveguide arms 6 and 7 (7 is not visible in FIG. 1) and 8 and 9 form series branchings SV shown in German OS 2,521,956 with a polarization separator or diplexer and are designed to be identical to each other. In the arrangement shown in FIG. 1, a single branching consists of two rectangular waveguides originally resting against each other at their wide sides which are symmetrically bent apart at the point where the partition begins. A small inductive reactance occurs at the bend location which produces a reflection factor of approximately 3%, for example, for an angle of 35 degrees, which reflection factor, however, can be compensated for broad-band by using a small capacitance at the bend location.

The four partial waveguide arms of the five-armed branching device are connected in pairs, i.e. the partial arms 2, 4, respectively, and 3, 5, respectively which lie opposite each other to the partial arms 6, 7, 8, 9, respectively of the series branching with separator or diplexer arm sections designed as E-offset or shift pieces 10, 11 which join 3 and 8 and 5 and 9 and with further separator or diplexer arm sections designed as H-offset pieces 12, which join 2 and 6 and 4 and 7, respectively 13 (13 is not visible in FIG. 1). The E-offset pieces illustrated above one another in FIG. 1 consist of respective rectangular waveguide pieces provided with waveguide bends 14, 14' or, respectively, 15, on both sides, and the rectangular waveguide piece is bent across the wide side in opposite directions by means of waveguide bends on both sides. In FIG. 1, the bend 14' is visible between arm 3 and piece 10, but the bend between arm 5 and piece 11 is not visible. Both E-offset pieces 10, 11 are parallel to each other and are aligned obliquely to the longitudinal axis of the device with their respective straight sections lying between two bends, so that their end cross-sections facing the partial arms 8, 9 of the series branching no longer lie symmetrically to the longitudinal axis of the device, but, rather, are displaced by a specific interval toward the top with respect to the longitudinal axis.

The separator arm sections provided in the other through-path of the polarization separator are designed as H-offset pieces 12, 13 and consist of a rectangular waveguide piece provided with a waveguide bends at both sides, which rectangular waveguide piece is bent across the narrow side in opposite directions with the waveguide bends at both sides. Thus, the two rectangular access cross-sections of the double branching lying above one another are displaced toward the top and the cross-sections of the horizontal waveguide pair are displaced toward the bottom so that the displaced cross-sections can be combined in pairs with two identical series branchings which do not penetrate each other.

In the arrangement according to FIG. 1, in detail, an E-offset consists of two E waveguide bends 14, 14' which, at a certain interval, are connected to one another with a bend direction at a certain interval which is opposite to each other, so that the input and output axes are parallel, but the access cross-sections are displaced with respect to each other in the direction of the E-lines by the interval $V_E$. A single E-bend can be designed as a single-stage bend compensated with smoothing or it can also be designed as a multi-stage for application where very low reflection is required.

In the device according to FIG. 1, the lower of the two E-offset pieces 11 is located between the two H-offset pieces 12, (13) lying next to each other which allow the horizontal waveguide pairs 2, 4 of the double branching DV to be displaced downwardly. Further, a H-offset piece consists of two waveguide bends 12*a*, 12*b* which are connected to each other with opposite bending directions at certain distances. The access cross-sections of each H-offset piece have their axes parallel and are displaced with respect to each other in the direction of the magnetic cross field. The H-offset can be designed analogously to the E-offset as described above.

In the polarization separator according to the referenced patent, partition plates TR are required for double branching DV in the intersection area of the five waveguide arms 1 through 5 for the suppression of the $E_{21}$-unwanted resonances in the frequency range used and partition plates require substantial manufacturing technology. Further, there is often the demand to further enlarge the frequency range of a phase-symmetrical polarization separator.

The object of the present invention, therefore, is to provide a further development of a polarization separator according to the referenced patent, which has simple manufacturing technology and, has a significantly broader frequency band width.

The object is achieved for an improved polarization separator with partial arms of the series branchings and the E- and H-offset pieces which have cross-section dimensions with a side ratio of at least approximately 1:4; and the partial arms of the double branching consist of waveguides which, with respect to their line impedance level, coincide with E- and H-offset pieces. The first arm of the double branching provide for connection of a continuing waveguide formed as a coaxial waveguide whose transition to the continuing waveguide is designed by means of cross-section graduation of the inner conductor and/or by means of cross-section graduation of the exterior conductor of the coaxial waveguide as an impedance level transformer.

In addition to the significant, simplified construction of the double branching wherein partition plates can be omitted, the invention offers the advantage that the four stage transmitters required in the rectangular waveguide sections of the polarization separator for the referenced patent can be omitted and can be replaced by a single stage transformer effective to the same degree for both polarizations, and the stage transformer is designed as a rotary part in round or quadratic waveguide connected to the double branching. Such rotary part is relatively simple to manufacture.

Due to the coaxial waveguide transformer, the further advantage results that the impedance level transformer can be connected in the closest electrical proximity to the main reactance of the double branching. By so doing, the two residual reflections of the impedance level transformer and of the double branching can be superimposed at small intervals and, thus, the vectorial sum can be made small over a broad-band.

In comparison to rectangular waveguide partial arms with a side ratio of 2:1 as are provided according to the referenced patent, it follows as a further advantage that the entire waveguide circuit can be dimensioned smaller with respect to the cross-section dimensions and, thus, can also be dimensioned shorter in the direction of the longitudinal axis of the total arrangement.

Further, the advantage that the E-bends in the waveguides of the side ratio 4:1 can be improved and broadband compensated than in a standard profile waveguide with side ratio of 2:1.

It is also advantageous when the partial arms of the double branching are designed as ridge waveguides. Since a ridge waveguide for a specific, fixed frequency range requires smaller cross-section dimensions with an increasing relative size of its center ridge, there ensues a further possibility for reducing the $E_{21}$-unwanted wave resonance space.

Figure 2A:
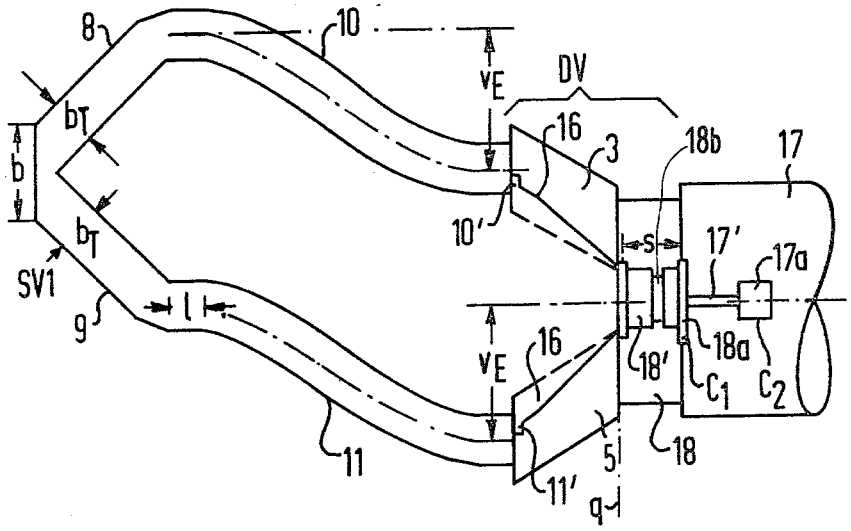
FIGS. 2*a* and 2*b* are sectional views of longitudinal sections in planes which are parallel to each other and illustrate the invention.
Figure 2B:
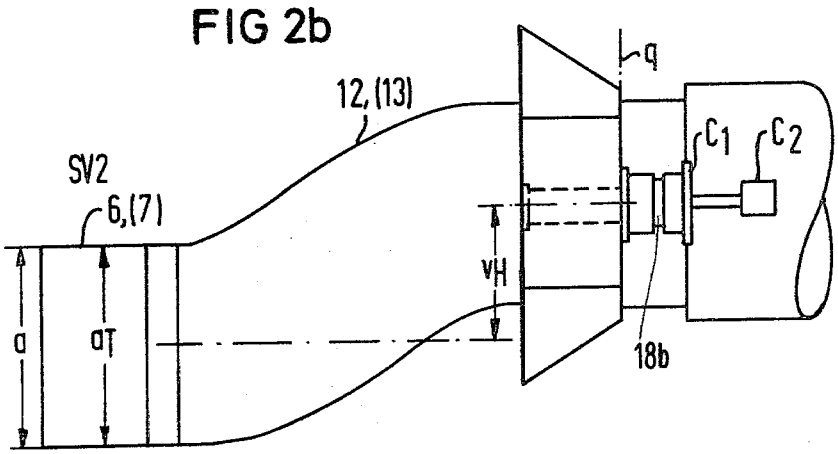

FIGS. 2*a* and 2*b* show two sectional views for longitudinal sections of a sample embodiment of the invention which are parallel to one another, whereby, for the sake of greater clarity, the two H-offset arms 12 and 13 and the associated series branching SV2 are omitted in FIG. 2*a*, and the two E-offset arms 10 and 11 and the associated series branching SV1 are omitted in FIG. 2*b*. The arrangement shown in FIGS. 2*a* and 2*b* differs from the arrangement shown in FIG. 1 in that the partial arms 8 and 9 of the first series branching SV1 and the E-offset arms 10 and 11 which are connected thereto have a side ratio with respect to their cross-sectional dimensions of 1:4. This is also true of the partial arms 6 and 7 of the second series branching SV2 and the H-offset pieces 12 and 13 connected thereto. Further, all four partial arms of the double branching DV are designed as ridge waveguides as can be seen in FIG. 2*a* in which the partial arms 3 and 5 have ridges 16.

In contrast to the arrangement according to the referenced German patent, in the sample embodiment according to FIGS. 2*a* and 2*b*, the rectangular partial waveguides 6 through 9 which continue toward the right after the low reflection division in the series branching portions SV1 and SV2 illustrated at the left maintain the original side ratio $a_T{:}b_T=4{:}1$ and the E-offset pieces 10, 11 connected thereto as well as the H-offset pieces 12, 13 also have this side ratio. Thus, up to the input of the double branching member DV, a completely homogeneous arrangement exists with respect to the localized line impedance level and in the arrangement only relatively small and, thus, leakage reactances which can be compensated occur in the series branchings and in the E- and H-offset pieces. The line impedance level corresponds to a rectangular waveguide with a side ratio of $a{:}b=4{:}1$ is retained in the partial arms 2 through 5 of the double branching.

With this arrangement, at the output of the double branching DV in the area of the cross-section surface q indicated in FIGS. 2*a* and 2*b*, an impedance level exists which is lower by a factor approaching 2 with respect to the waveguide arm (for example, round) feeding toward the right, which results in a reflection factor $r_{\Delta Z}=1/3$. A transformer in the round waveguide is connected to the double branching DV and is equally effective for both polarizations so that this impedance level jump is bridged with very low reflection, as will be explained in greater detail below.

The first arm 18 of the double branching is provided for the connection of a continuing waveguide 17 and is formed as a coaxial waveguide whose transition to the continuing waveguide 17 is designed as an impedance level transformer having a cross-section graduation of the inner conductor 18' of the coaxial waveguide 18. The coaxial waveguide 18 connected at the right to the double branching as shown in FIGS. 2*a* and 2*b* and is provided with a stepped inner conductor 18', 18*a* with a diameter such that the line impedance level of the coaxial waveguide 18 where connected to the continuing waveguide 17 coincides with the line impedance level of the continuing waveguide 17. For retaining the $H_{11}$-limiting frequency, the diameter of the outer conductor in the area of the coaxial waveguide 18 is reduced relative to the diameter of the round waveguide 17. The broad-band, low-reflection transition from the coaxial waveguide to the round or quadratic output waveguide, is thus created with a single-stage transformer in which the necessary impedance level jumps are realized in a very simple manner in that either only the inner conductor 18' is stepped down until its disappears at the output cross-section in the manner of a stepped wave or the outer conductor of the coaxial waveguide 18 is additionally stepped, for example, in the direction opposite to that of the inner conductor 18'. A plurality of quarterwave steps can also be employed for a particularly low-reflection waveguide transformer. Further, a conical contour of the inner and outer conductor can be used. The inner pyramid of the double branching can be used for precise center fastening of the inner conductor.

In the invention, operation occurs in lower and upper frequency ranges which are for example, the frequency ranges of four or six GHz as mentioned above. The index "u" in the application is employed for the upper frequency range and the index "o" is employed for the lower frequency range.

The lower frequency range extends from 3.7 through 4.2 G hertz and the upper frequency range extends from 5.9 through 6.4 G hertz. In this application, the respectively appertaining wave guide wave sections are identified with the indexes "u" or "o", respectively.

In general, a single-stage transformer as illustrated in FIGS. 2*a* and 2*b* is sufficient it its stage in the upper frequency band has a length of $s=\lambda_{Ho}/4$ and whose residual reflection in the lower frequency band is compensated with a double capacitance of the following type. According to FIGS. 2*a* and 2*b*, this double capacitance consists of the partial capacitances $C_1$ and $C_2$ which are approximately of equal size at the upper frequency band and which have a mutual interval for the upper frequency band of approximately $\lambda_{Ho}/4$ and, therefore, are of negligible effect. The first of the partial capacitances $C_1$, is provided by an abrupt enlargement of the cross-section 18*a* of the inner conductor 18' at the end of the transformer stage. A coupling cylindrical portion 18*b* of smaller cross-section joins inner conductor 18' and the enlarged cross-section portion 18*a* of the inner conductor. The second partial capacitance $C_2$ is formed by an enlargement of the cross-section 17*a* of the inner conductor 17' of relatively small diameter which continues into the succeeding waveguide 17. The electrical effect of the two partial capacitances is significantly smaller than $\lambda_{Hu}/4$ for the lower frequency range, so that resulting capacitances which are between the two partial capacitances remains, which partial capacitances can be mechanically coupled together for the correction of the single-stage impedance level transformer in the lower frequency range at the point which is optimum for this purpose, without the impedance level values being degraded for the upper frequency range.

As shown in FIGS. 2*a* and 2*b*, both the round inner conductor as well as the outer conductor of the coaxial waveguide can be provided with additional enlargements for fine compensation which act as a parallel capacitance or, respectively, can be provided with recesses functioning as series inductance.

In a double branching DV executed with rectangular partial waveguide cross-sections of the side ratio $a_T:b_T=4:1$, the $E_{21}$-unwanted resonance advantageously lies higher than with partial arms with a side ratio of 2:1 as used in the referenced patent, since the $E_{21}$-resonance space in the intersection area of the double branching also becomes smaller with the reduction of the cross dimensions. The alternative of incorporating wave mode selective coupling devices, for example, in the simplest case, a $E_{01}$-axial probe, in the interior space of the inner conductor of the coaxial waveguide 18 is also advantageous.

In the reduced outer conductor diameter in the sample embodiment, the inner conductor of the coaxial waveguide results in an additional pre-emphasis of the $E_{21}$-unwanted wave resonance because the $E_{21}$ limiting frequency in the waveguide transformer is emphasized because of the displacement along the tubular axis of the magnetic field energy predominating for the $E_{21}$-wave mode and, because of this, the $E_{21}$-short-circuit plane formed by it (i.e., the waveguide transformer) moves closer to the double branching point, whereby the $E_{21}$ resonance space is even further shortened.

A further geometrical attenuation of the double branching structure whose lateral openings to the two respectively neighboring partial waveguides in the intersection area also determine the length of the $E_{21}$ resonator occurs in that the two outer longitudinal edges of the ridge waveguide which are closer to the axis are formed with a greater radius of curvature than the other cross-section edges of the ridge waveguide. This can be seen from the structure of FIG. 3 which shows the connection cross-section of the double branching structure to the E- and H-offset pieces. The radius of curvature of the longitudinal edges which are further from the axis are referenced in FIG. 3 with $r_a$ and the radius of curvature of the outer longitudinal edges which are closer to the axis are referenced with $r_i$.

By these means for boosting the $E_{21}$-unwanted resonance, it is assured that, after omitting the partition plates of the double branching, even at the highest frequency used, the $H_{20}$ limiting frequency of the E- and H-offset pieces, that the $E_{21}$-unwanted resonance still lies sufficiently far above the highest operating frequency so that it causes no problems.

In the sample embodiment, the double branching, which no longer requires any partition plates, discloses a disk-shaped form and they can be manufactured as milled parts with a minimum outlay in one operation.

Figure 3:
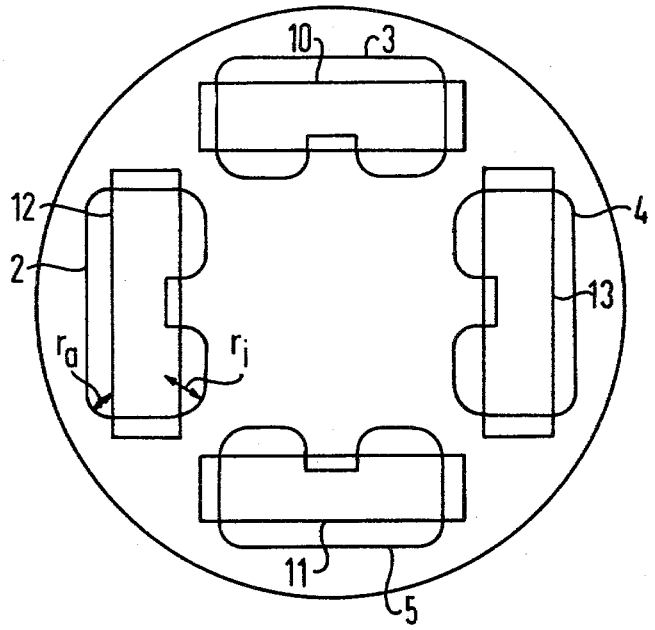
FIG. 3 is a plan view of the invention.

In the sample embodiment, the ridge waveguides of the double branching are dimensioned such that they approximately exhibit the same $H_{10}$-limiting frequency as the E- and H-offset pieces. With respect to the impedance level, the ridge waveguides are adapted to the E-H-offset pieces in the entire frequency range from 3.7 GHz through 6.425 GHz. By so doing, the abutting waveguide cross-sections can be connected by a flange to one another without transitions in a simple manner, as is shown in FIG. 3.

For the compensation of the E-bends of the E-offset pieces 10 and 11 leading toward the right to the longitudinal axis, a small parallel capacitance in the form of a projection 10' or, respectively, 11' is respectively provided in the sample embodiment, which parallel capacitance extends over the waveguide ridge of the double branching. The corresponding is true for the connection cross-sections to the H-offset pieces. Despite the discontinuity at the point of irregularity from the offset pieces to the ridge waveguides of the double branching to be seen in FIG. 3, the homogeneity of the line impedance level is retained. At the intersection area of the double branching means, the height of the ridges 16 between those sides of the partial arms of the double branching designed as ridge waveguides which face the E- and H-offset pieces and those sides which face the waveguide 18 decrease continuously, so that the ridge waveguide which is disintegrating along its broad side because of the lateral intersection openings to the two ridge waveguides of the double branching which respectively bound it are compensated in impedance.

An additional shortening of the polarization separator is achieved according to FIGS. 2*a* and 2*b*, in that both the H- as well as the E-offset pieces exhibit an S-shaped, curved line section between the end bends, respectively, opposite one another instead of a straight line section. Thereby, the radius of curvature of these circular arc lines is selected in such a manner that disruptive reflections do not occur. By so doing, it is achieved that the lateral offsets $v_E$ and $v_H$ required for reasons of topology for the penetration-free telescoping of the longitudinal sections according to FIGS. 2*a* and 2*b*, can be reduced with respect to the longitudinal axis of the arrangement by approximately 1/3 without significant increases of reflection. This is of significance because the reflections arising in the E- and H-offset pieces are not symmetrical in phase. Thus, the phase symmetry of the polarization separator can be even further improved by means of the employment of S-arc lines instead of straight lines for the offset pieces.

Although the invention has been described with respect to preferred embodiments, it is not to be so limited as changes and modifications can be made which are within the full intended scope of the invention as defined by the appended claims.

I claim as my invention:

1. A polarization separator for upper and lower of two frequency range devices having waveguide sections of rectangular and round cross-section, with a double branching waveguide, which is symmetrically constructed and has five-arms with a first arm lying in the longitudinal axis of the separator for connecting a continuing waveguide of round cross-section, and four partial branching arms of rectangular cross-section and which are mounted 90 degrees with respect to each other and extend generally parallel to the longitudinal axis of the separator and said four partial arms extending in a direction opposite to the first arm and with a first pair of said partial arms mounted opposite one another and each connected with one of a first pair of separator arm sections which connect said partial arms to a first pair of identically formed series waveguides, a second pair of said partial arms mounted opposite one another and each connected to one of a second pair of separator arm sections, and wherein two separator arm sections which lie opposite each other and the series waveguides are formed as E-offset waveguides and as H-offset waveguides, respectively and the E-offset waveguides are designed as rectangular waveguide sections which are provided on both sides with a waveguide bend and are respectively bent across the broad side of the waveguide in opposite directions on both sides and both E-offset waveguides are aligned with respect to their narrow sides obliquely to the longitudinal axis of the separator and extend parallel to each other and the H-offset waveguides are respectively designed as rectangular waveguide sections which have on both sides a waveguide bend and are respectively bent across the narrow side of the waveguide in opposite directions and one of the E-offset waveguide sections is mounted between the two H-offset waveguides in such manner that the series waveguides connected to the E-offset waveguide and the H-offset waveguides are formed so that their partial arms do not penetrate each other, characterized in that the partial arms (6 through 9) of the series waveguides (SV1, SV2) and the E-offset and H-offset waveguides (10 through 13) have a side ratio of at least approximately 1:4 with respect to their cross-section dimensions; and the partial arms (2 through 5) of the double branching waveguides consist of waveguides which have the same impedance as the E- and H-offset waveguides, and the first arm (18) of the double branching waveguides (DV) is connected to a continuing waveguide (17) which is formed as a coaxial waveguide and the transition from waveguide (18) to the continuing waveguide (17) is designed as an impedance level transformer by means of cross-section variations (**18*a*, 18*b*) of the inner conductor (18'**) of the coaxial waveguide.

2. A polarization separator according to claim 1, characterized in that the E- and H-offset waveguides (10 through 13) are designed as S-shaped, curved line sections between their end bends which are respectively opposite one another.

3. A polarization separator according to claim 1, characterized in that the partial arms (2 through 5) of the double branching waveguides are designed as ridge waveguides.

4. A polarization separator according to claim 3, characterized in that the transition waveguide (18) is designed as an impedance level transformer and is formed as a single-stage and has a length of $\lambda_{Ho}/4$ with respect to the upper frequency range of two separate frequency ranges where $\lambda_{Ho}$ is the wavelength of the upper frequency of the waveguide.

5. A polarization separator according to claim 4, characterized in that the residual reflection of the coaxial waveguide (18) at the lower of the two frequency ranges is compensated in that the partial capacitance $C_1$ formed by means of a first, rotational-symmetrical, wall-shaped inner line enlarged portion (**18*a*) is supplemented by means of the partial capacitance $C_2$ of a second wall-shaped inner conductor enlarged portion (17*a*) which is rotationally-symmetrical at an interval of approximately $\lambda_{Ho}/4$ from the first enlarged portion (18*a***).

6. A polarization separator according to claim 5, characterized in that the outer conductor of the coaxial waveguide (18) is changed in dimensions so that it is stepped in the opposite direction to the inner conductor (18').

7. A polarization separator according to claim 6, characterized in that the inner conductor of the coaxial waveguide 18 has depression (**18*b***) which are rotational-symmetrical.

8. A polarization separator according to claim 6, characterized in that the inner conductor of the coaxial waveguide has an enlarged portion (**18*a***) which is rotational-symmetrically.

9. A polarization separator according to claim 6, characterized in that the inner conductor (18') of the coaxial waveguide (18) and the inner conductor (17', **17*a*) of the continuing waveguide (17**) comprise wave mode selective coupling devices.

10. A polarization separator according to claim 3, characterized in that the ridges (16) of the partial arms (2 through 5) of the double branching waveguide (DV) are designed as ridge waveguides and are located at the longitudinal sides of the waveguide which are nearest the axis; and the two longitudinal edges of the ridge waveguide which are nearest the axis have a greater radius of curvature $r_i$ than the remaining cross-section edges of the ridge waveguide.

11. A polarization separator according to claim 10, characterized in that the height of the ridges (16) between those sides of the partial arms (2 through 5) of the double branching waveguide (DV) which face the E- and H-offset waveguides (10 through 13) and the sides facing the coaxial waveguide (18) continuously decrease in size.

12. A polarization separator according to claim 10, characterized in that the $TE_{10}$ cut off frequency of the ridge waveguides of the corresponding partial waveguides of the coaxial waveguide and of the E- and H-offset waveguides approximately coincide.

* * * * *